US005788283A

United States Patent [19]

Adler

[11] Patent Number: 5,788,283

[45] Date of Patent: Aug. 4, 1998

[54] SCORE KEEPING GAME SYSTEM

[76] Inventor: Bradley A. Adler, 1474 Greenbriar Cir., Baltimore, Md. 21208

[21] Appl. No.: 678,111

[22] Filed: Jul. 11, 1996

[51] Int. Cl.[6] ..... B42D 1/00

[52] U.S. Cl. ..... 281/38; 402/79

[58] Field of Search ..... 281/38, 21.1, 45, 281/51; 283/65, 66.1, 115; 402/79

[56] References Cited

U.S. PATENT DOCUMENTS

| | | | |
|---|---|---|---|
| 1,449,045 | 3/1923 | Hollander | 283/65 |
| 5,265,359 | 11/1993 | Glazer et al. | 402/79 X |
| 5,509,746 | 4/1996 | Ho | 402/74 |

*Primary Examiner*—Willmon Fridie, Jr.

*Attorney, Agent, or Firm*—Rosenberg, Klein & Bilker

[57] ABSTRACT

A score keeping game system (100) for tracking the performance of at least one athlete is provided. Score keeping game system (100) includes at least one score tracking device (10), the score tracking device including a card member (60) and jacket (70). Card member (60) includes a recording section (66) formed on one side thereof and having subdivision indicia markings (80) formed thereon for indicating and subdividing the recording section (66). Jacket (70) is formed by a pair of wall members (72, 74) formed of a plastic material and joined together with an opening on one edge thereof for passage of the card member (60) between the pair of wall members (72, 74). At least one of the wall members (74) has an opening (76) formed therethrough to provide access to the recording section (66) of the card member (60).

17 Claims, 7 Drawing Sheets

SCORE KEEPING GAME SYSTEM

BACKGROUND OF THE INVENTION

1. Field of the Invention

This invention directs itself to a game system for tracking the performance of an athlete during the course of a playing season. In particular, this invention directs itself to a system for combining the activities related to the collection of sports figure trading cards and tracking the performance of particular sports figures corresponding to the collected trading cards. More in particular, this invention pertains to a game system wherein a plurality of score tracking devices may be grouped together and captured within a binder, allowing the personal statistics for any of the athletes being tracked to be updated without requiring displacement of the trading card/score keeping card from the protective jacket in which they are maintained. Still further, this invention directs itself to a game system which may incorporate accessories such as marking devices, adhesive-backed labels and removable identifying markers to further enhance the trading card collection and performance tracking activities of the user.

2. Prior Art

The collection of sports figure trading cards is an activity which has been enjoyed by many individuals throughout the years. While such trading cards have provided personal statistical information for the players represented thereon, such cards have never provided for user interaction, allowing a user to provide their own indications of the athletic achievements of the sports figure during the course of a season. Further, plastic envelopes are known which are available for storage of such trading cards, and albums exist wherein the trading cards may be maintained within a respective transparent pocket. However, such devices have provided no apertures through which a portion of the card can be accessed for applying particular markings thereto without requiring the removal of the card from the protective jacket. While the collection of trading cards provides for a pleasurable pastime, and the observation of the sporting activities associated with the players depicted on the trading cards is also enjoyable, as is reading sports periodicals, there has heretofore been no game system which symbiotically combine these activities to enhance the pleasure obtained from each activity.

SUMMARY OF THE INVENTION

A score keeping game system for tracking an athlete's performance is provided. The score keeping game system includes a card member having opposing first and second planar sides. At least one of the first and second planar sides having at least one recording section thereof indicated by indicia for recording the athlete's achievements thereon. The score keeping game system also includes a pair of transparent wall members joined together to form a jacket open on at least one edge portion thereof to receive the card member therein. A first of the pair of transparent wall members has an opening formed therethrough. The opening is aligned and dimensioned for accessing the recording section of the card member.

DESCRIPTION OF THE PREFERRED EMBODIMENTS

Figure 1:
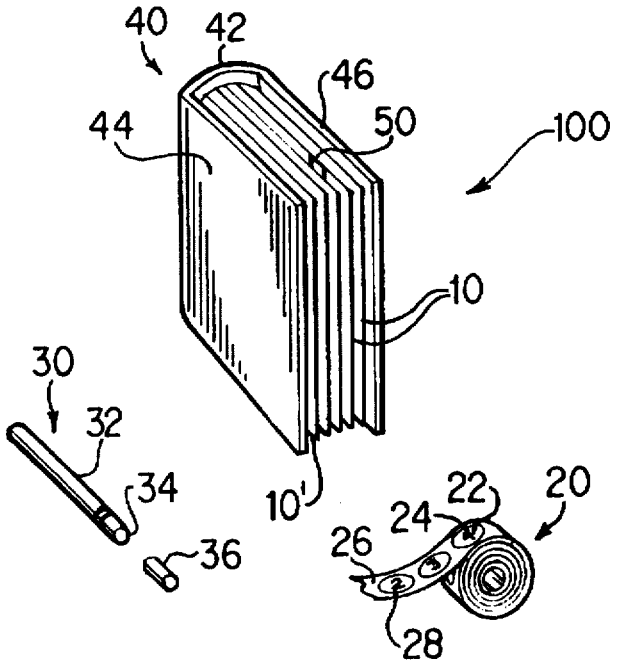
FIG. 1 is a perspective view of the score keeping game system of the present invention.

Referring to FIGS. 1–11, there is shown, score keeping game system 100 for tracking an athlete's performance over the course of a season. As will be seen in following paragraphs, score keeping game system 100 is specifically directed to the concept of providing a card member 60 having at least a portion 66 of one planar side 62 thereof indicated by indicia 80, 82, 84, 86, 88 for recording the athlete's achievements thereon, the card member 60 being disposed within a jacket 70 having an opening 76 formed therethrough to permit access to the recording portion 66 of card member 60 by a marking device 30. Still further, the card member may include label receiving areas 167 for placement of respective ones of a plurality of adhesive-backed labels, each label having differing indicia formed on a front surface thereof. Further, a plurality of card members 60 and a corresponding plurality of jackets 70 may be provided, the plurality of jackets 70 being captured between a pair of cover members 44, 46 of a binder 42 to form a tracking set 40.

As shown in FIG. 1, score keeping game system 100 includes at least one score tracking device 10, to be further detailed in following paragraphs. Where a plurality of score tracking devices 10 are provided, such may be formed into a tracking set 40 wherein the tracking devices 10 are captured within a binder 42. Binder 42 includes a front cover 44 and rear cover 46 with the score tracking devices 10 bound therebetween, by methods well known in the art. Binder 42 may be what is termed a "loose-leaf" type binder wherein the score tracking devices 10 are releasably coupled between the covers 44 and 46.

Score keeping game system 100 may further include a marking device 30 having a handle portion 32 and a marking portion 34. In its simplest form, marking device 30 may be a conventional felt-tip or other type pen. Alternately, marking portion 34 may be in the form of a rubber stamp for making an inked imprint on the card member 60 of the score tracking devices 10. The marking device 30 further may include a cap 36 which may incorporated an ink pad therein for applying ink to the rubber stamp portion 34 of marking device 30. Still further, score keeping game system 100 may incorporate a plurality of labels 20 wherein a plurality of adhesive-backed labels 22 are supplied on a backing strip 26. Each of the plurality of labels 22 include an upper surface 24 having indicia 28 formed thereon. The labels may be grouped into sets, wherein each of a set of the plurality of labels 22 have differing indicia formed thereon, which differing indicia are repeated by the additional sets of such labels. The labels 22 will be utilized by the user of score keeping game system 100 to identify season totals on the score keeping card 60, with each set of labels being associated with different performance categories, as will be described in following paragraphs.

Figure 2A:
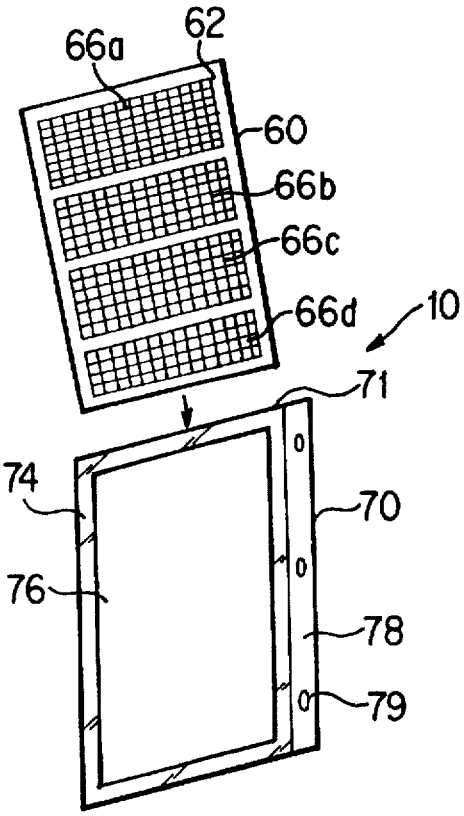
FIGS. 2A and 2B are perspective views of a score tracking device of the present invention.
Figure 2B:
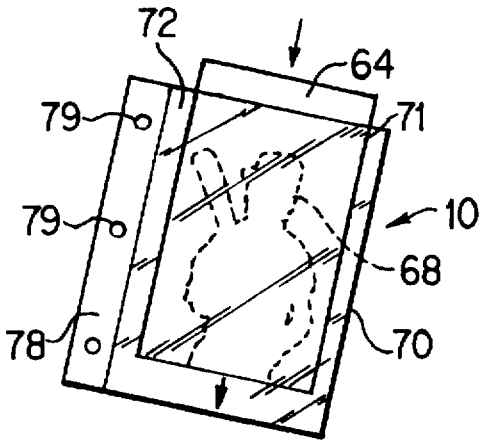

Referring now to FIGS. 2A and 2B, there is shown, a score tracking device 10 of game system 100. Score tracking device 10 includes a card member 60 having a front side 64 and a rear side 62. Rear side 62 includes a recording section 66 which may be subdivided into separate recording sections 66*a*, 66*b*, 66*c*, 66*d*, each indicated by indicia. The front side 64 of card member 60 is provided with a photographic-like image indicia section 68, depicting the particular athlete whose achievements are to be tracked and recorded on the recording section 66. Score tracking device 10 further includes a transparent plastic jacket 70 for holding the card member 60 therein.

Jacket 70 includes a front wall 72 which overlays the photographic-like image indicia section 68 of card member 60 to provide a protective covering therefor. Jacket 70 further includes a rear wall 74 secured to front wall 72 on perimeter edges thereof, leaving end 71 open for receiving and withdrawing card member 60 from jacket 70. Rear wall 74 is further provided with an opening 76 formed therethrough, dimensioned and positioned for alignment with the recording section 66 to permit access for applying appropriate markings to the recording subsections 66*a*, 66*b*, 66*c*, 66*d*. Thus, it is not necessary that rear wall 74 be transparent, other than for simplification of the manufacturing process for jacket 70. Jacket 70 further includes an extended portion 78 for coupling within the binder 42. Where binder 42 is a loose-leaf type system, extended portion 78 of jacket 70 is provided with a plurality of through openings 79 for releasable coupling within binder 42.

Figure 3:
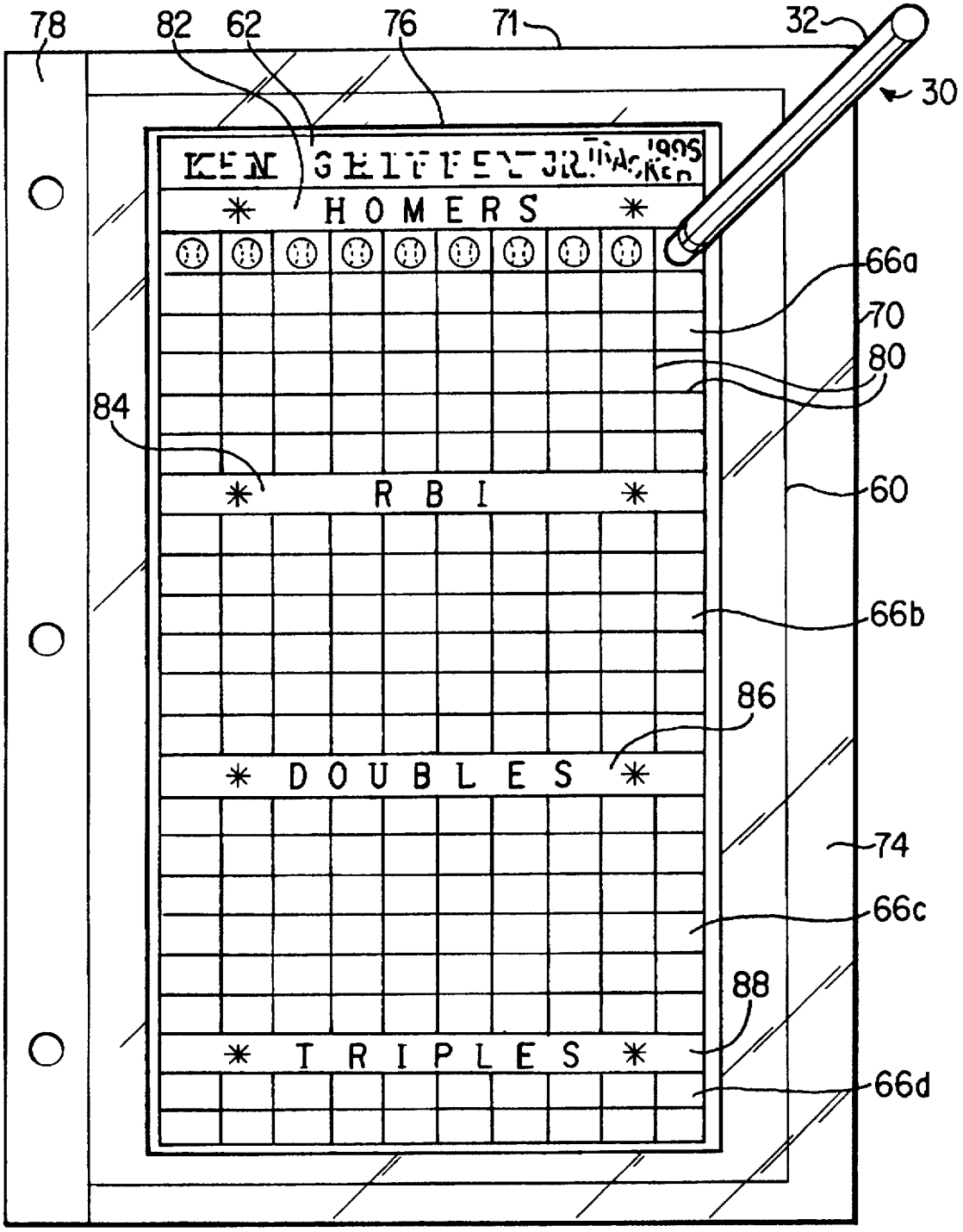
FIG. 3 is an elevation view of the score tracking device of the present invention.

When card member 60 is positioned within the jacket 70, as shown in FIG. 3, the user will have full access to the recording subsections 66*a*, 66*b*, 66*c*, 66*d* for providing indications thereon of the achievements of an athlete whose performance is being tracked and whose image is displayed in section 68 on the front side 64. Each of the recording subsections 66*a*, 66*b*, 66*c*, 66*d* are indicated by indicia 80 defining subdivision markings which define individual marking spaces within the particular recording subsection. Each recording subsection is identified by a category indication 82, 84, 86, 88. Shown in FIG. 3, is an example of category indications of a score tracking card member for a baseball player, allowing the user to track a player's home runs, runs batted in, doubles, and triples. Obviously, other athletic performance criteria can be utilized for the sport of baseball, and obviously, would be different for other sports activities, as exemplified in Table 1.

TABLE 1

EXAMPLES OF SUBDIVISION HEADINGS

| SUB-DIVI- | SPORT | | | |
|---|---|---|---|---|
| SION | BASEBALL | FOOTBALL | HOCKEY | BASKETBALL |
| 82 | Homeruns | Passing TD's | Goals | 50+ Point Game |
| 84 | RBI's | Rushing TD's | Assists | 40+ Point Game |
| 86 | Doubles | 300 Yard Games | Points | Triple Doubles |
| 88 | Triples | Interceptions | Hat Tricks | 15+ Rebounds |

With the card member 60 positioned within jacket 70, the user utilizes marking device 30 to place an indication within one of the spaces delineated by the subdivision markings in the appropriate recording subsection 66*a*, 66*b*, 66*c*, 66*d* each time the athlete being tracked meets the achievement criteria for one of the categories 82, 84, 86, 88. If marking device 30 is a conventional marking device, such as a felt tip pen, the user simply places a check mark, an X, or some other indicia in the appropriate portion of the recording area. Where marking device 30 is a stamping device, such is used to place a symbol image in the delineated spaces of the recording area as achievement criteria is met. Where game system 100 is directed to tracking the performance of baseball players, the stamp may provide the symbol of a baseball or a diamond, for example. Where system 100 is being utilized to track the performance of football players, stamp 32 may produce the symbol of a football or goal posts. For hockey, game system 100 may include a stamp which produces the symbol of a hockey stick or puck, while for a game directed to basketball, the stamp may produce the symbol of a basketball. Obviously, other symbols may be incorporated into the stamp end 34 of the marking device 30.

Card member 60 may be dimensioned so as to be in the form of a "trading card" where the front side 64 carries the photographic-like image of a sports figure and the rear side 62 carries the subdivision markings 80 and category indications 82, 84, 86, 88, indicating the recording section upon which a user provides indications of that particular athlete's achievements. By virtue of the jacket 70, the trading card 60 is maintained in optimum condition, while the aperture 76 formed through the rear wall 74 of jacket 70 allows the user to place the appropriate markings in the recording subsections 66*a*, 66*b*, 66*c*, 66*d* without having to handle the trading card 60 each time an entry is to be made. The enjoyment of score keeping game system 100 is enhanced where a plurality of score tracking devices 10 are maintained together in a binder 42 to form a tracking set 40. A user may then track the performance of each athlete in a team, or their favorite athlete from a number of different teams and/or sports. The tracking set 40 makes the playing of a "fantasy team" easier and more enjoyable, and may include a team card in a team tracking device 10', where the "team's" statistics can be maintained in a jacket 70. When binder 42 includes means for releasably coupling the plurality of score tracking devices 10, then a user may exchange selected ones of the plurality of score tracking devices 10 or remove them to trade or sell, with the jacket 70 being maintained as a protective cover for the trading cards 60.

Figure 4B:
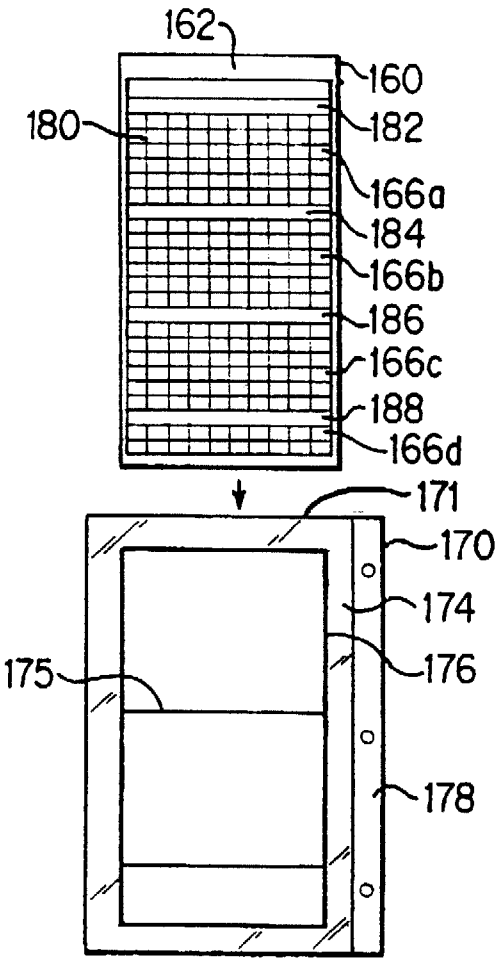
FIGS. 4A and 4B are exploded elevation views of a score tracking device of the present invention.
Figure 4A:
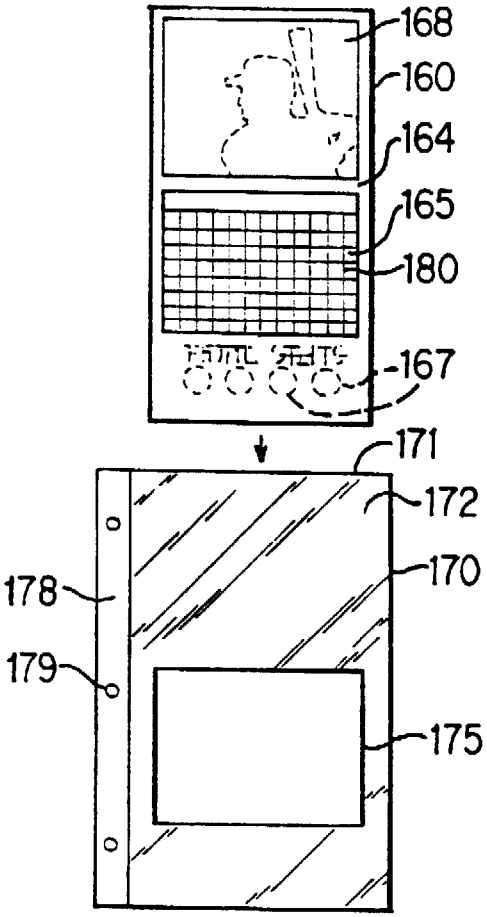

Referring now to FIGS. 4A and 4B, there is shown, an alternate configuration of the score tracking device 10 of score keeping game system 100. The rear side 162 of card member 160 is essentially the same as previously described, with a plurality of recording subsections 166*a*, 166*b*, 166*c*, 166*d*. Each of the recording subsections are delineated by subdivision markings 180, which may form a cross-hatch pattern in each of the recording subsections. Further, each recording subsection may be identified with particular category indications provided in the areas 182, 184, 186, 188. The front side 164 of card member 160, however, includes both a photographic-like image indicia section 168 and an additional recording section 165. Recording section 165 is also delineated by subdivision markings 180. Area 165 may be a continuation of one of the areas 166*a*, 166*b*, 166*c*, 166*d*, or may represent a recording area for an additional category. Additionally, the front side 164 of card member 160 includes a plurality of label receiving areas 167 spaced from photographic-like image indicia section 168 and the recording section 165. It should be understood that card member 160 may include area 165 without areas 167, or include areas 167 without inclusion of area 165, all without departing from the inventive concept embodied in system 100.

Card member 160 is received within a jacket 170 formed by a transparent plastic front wall 172 and a plastic rear wall 74, which may also be formed by transparent material. Front wall 172 and rear wall 174 are joined together along the perimeter edges thereof, with at least one perimeter edge being left open, to form open end 171 for insertion and removal of card member 160. Jacket 170 further includes an extended portion 178, which may have a plurality of through openings 179 formed therein for use with a loose-leaf type binder 42. Obviously, the extended portion 178 may be permanently bound within a binder 42 by methods well known in the art.

The rear wall 174 of jacket 170 includes an opening 176 formed therethrough and positioned for alignment with the recording area indicated by the subdivision markings 80 and category indications 82, 84, 86, 88 on the rear side 162 of card member 160. The alignment of the recording subsections formed on card member 160 with the opening 176 allows the user to provide markings thereon without removing card member 160 from jacket 170. Likewise, the front wall 172 includes a second opening 175 formed therethrough, and positioned for alignment with the recording section 165 formed on the front side 164 of card member 160. The non-apertured portion of front wall 172 overlays the photographic-like image indicia section 168, providing a protective covering therefor. Thus, each time an athlete corresponding to one of the user's card members 160 achieves the goal of one of the performance categories, the marking device 30 is utilized to provide an indication of such in a space defined by the subdivision markings 180 in one of the recording subsections 165, 166*a*, 166*b*, 166*c*, 166*d*. It is contemplated that the user would appreciate having some indication of the totals for each of the categories, and such is provided by means of the adhesive-backed labels 22. Therefore, adhesive-backed labels 22 are provided with a plurality of differing indicia 28 formed on the upper surface 24 of each label, and may include multiple sets of such differing indicia, one set for each category. As an alternative, other labeling devices may be used to indicate season totals. As the labels 22 are intended to be secured to the appropriate label receiving areas 167 at the end of the season, such may be added to card 160 subsequent to removal from jacket 170, the label receiving areas 167 being covered by a non-apertured portion of the front wall 172. It is not beyond the scope of the instant invention to provide the opening 175 sufficiently large to allow access to the label receiving areas 167 and provide labels 22 with a non-permanent adhesive to allow frequency updating of totals using labels 22, if such were desired.

Figure 5:
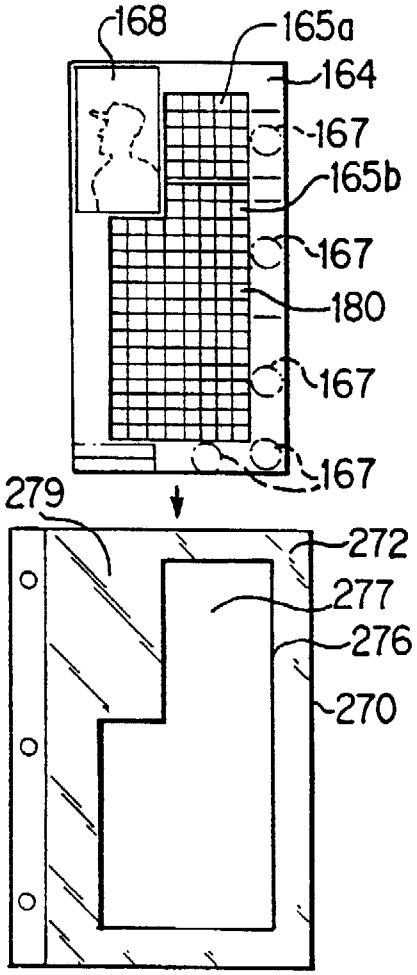
FIG. 5 is an exploded elevation view of another alternate configuration of the score tracking device of the present invention.

FIG. 5 shows another configuration for the front surface 164 of card member 160. In the configuration shown, the photographic-like image indicia section 168 is confined to an upper portion of the card member adjacent one side edge thereof. By such location of the section 168, more space is provided for additional recording subsection areas 165*a*, 165*b*, each with subdivision markings 180. A plurality of label receiving areas 167 are also provided, such being located adjacent the perimeter edges of card 160. In order to accommodate the different configuration of the front side 164, a jacket 270 is provided. Jacket 270 includes a front wall 272 contoured to provide an image overlying area 279 with a through opening 277 contoured to be alignment with the recording subsections 165*a* and 165*b*.

Figure 6:
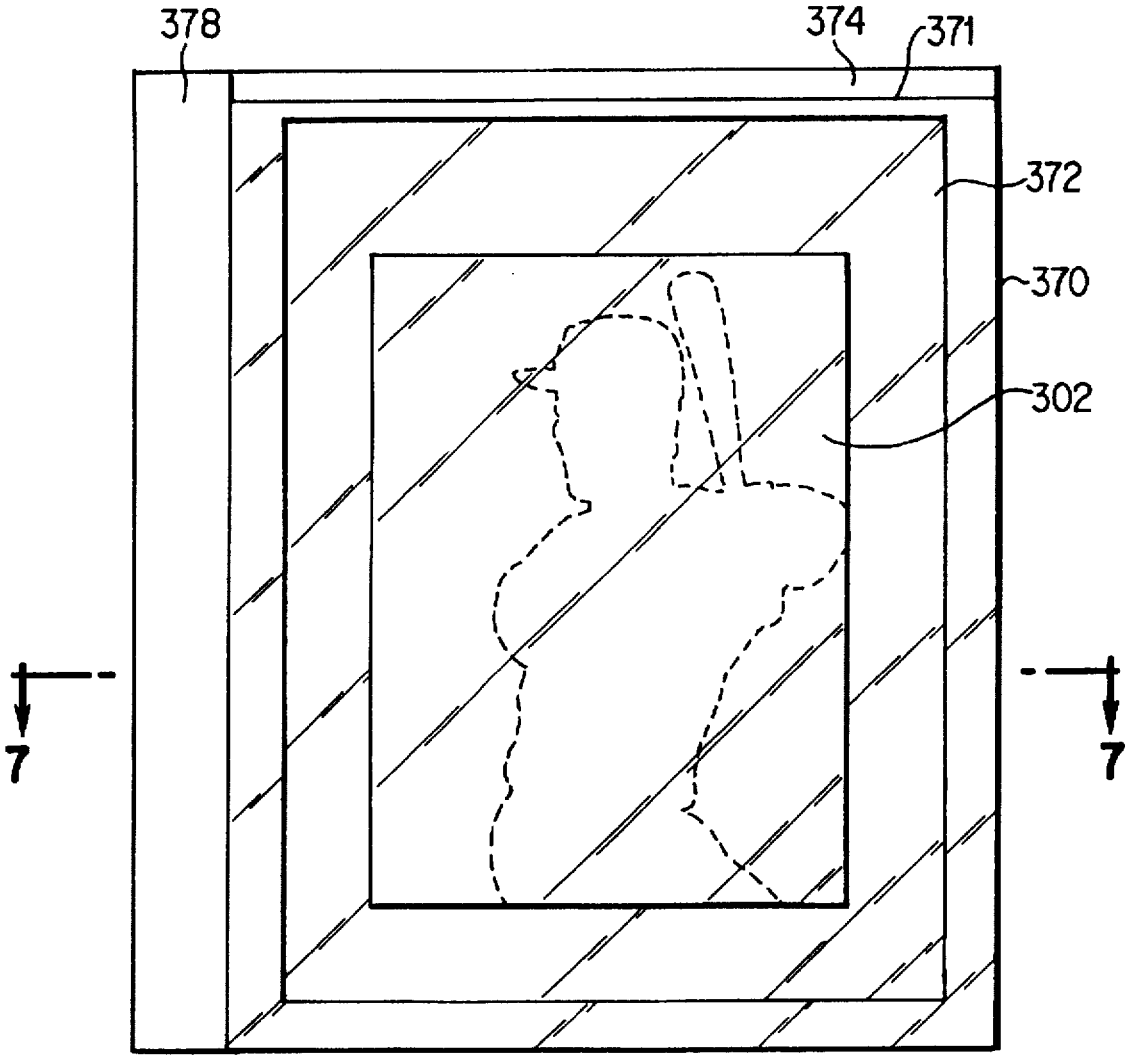
FIG. 6 is an elevation view of an alternate embodiment of the score tracking device of the present invention.
Figure 7:
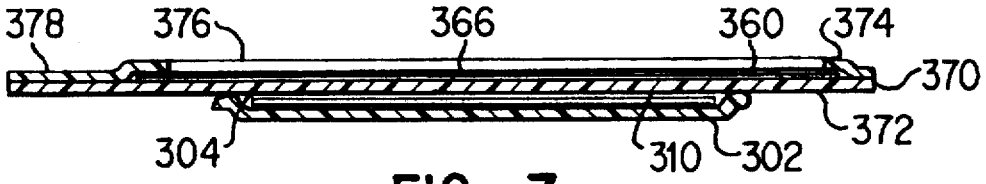
FIG. 7 is a cross-sectional view of the score tracking device of FIG. 6, taken along the section line 7—7.
Figure 8:
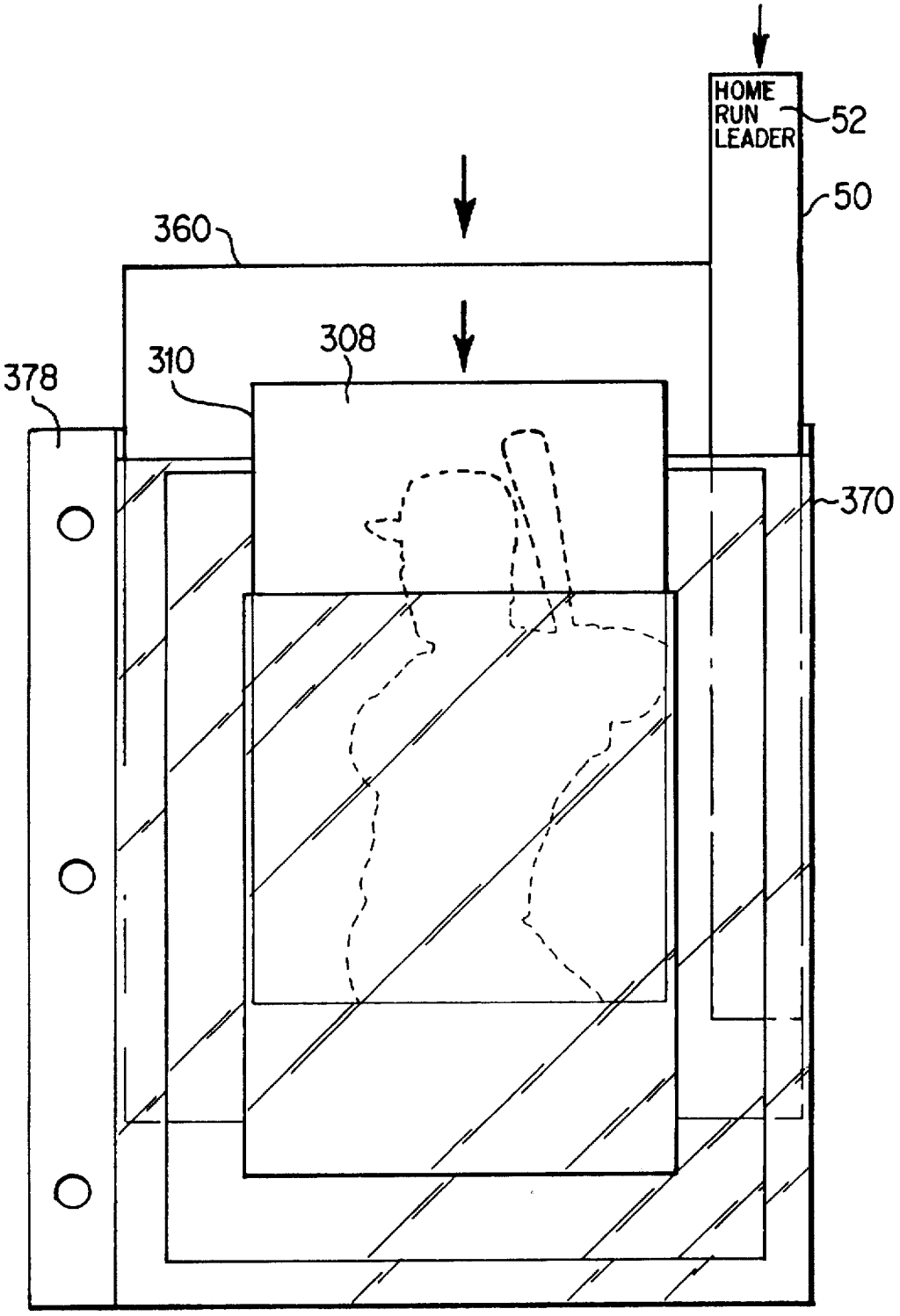
FIG. 8 is an elevation view of the jacket of the embodiment of FIG. 6, depicting insertion of the trading and score keeping cards therein.

Turning now to FIGS. 6, 7 and 8, there is shown, an alternate embodiment of the score tracking device 10 of score keeping game system 100. In this embodiment, a jacket 370 is provided for holding both a score tracking card member 360 and a conventional trading card 310. Jacket 370 allows a user to maintain the score tracking card 360 in association with the trading card 310 which corresponds to the athlete whose performance is being tracked, while maintaining such training card in its original pristine condition. When provided as a plurality of score tracking devices 10 to form a tracking set 40, the card members 360 and jackets 370 provide an ideal arrangement for the user to participate in a "fantasy league" game. This embodiment of system 100 will permit a user to trade players in the user's "fantasy team" with players from another's team, the user simply using a new card member 360 to track the player's performance in the user's "fantasy team". To further facilitate the playing of the game, tracking device 10' having a tracking card 360 would also be included in the tracking set 40 it its own packet 370 for accumulation of the team's statistics thereon.

Jacket 370 is formed by respective front and back walls 372 and 374, formed of a plastic material and secured together about the perimeter edges thereof, with the exception of at least one edge 371 to allow insert and removal of the card member 360. As shown in FIG. 6, rear wall member 374 may have a length which extends slightly beyond the length of front wall 372, to better delineate the open edge 371 and provide easier access to the space between front wall 372 and rear wall 374. Like the embodiments discussed previously, rear wall 374 is provided with an opening 376 through which the user accesses the respective recording section of card member 360, which recording section is like those previously described and is therefore not now repeated. Jacket 370 includes a third transparent wall member 302 secured to the outer surface of the wall member 372, secured substantially about three perimeter edges thereof to form a pocket 304 of sufficient dimensions for receiving the trading card 310 therein. It is well within the scope of the instant invention that the third wall member be dimensioned to have substantially the same width, and/or length as that of the wall member 372, to provide for more efficient manufacture of jacket 370.

Figure 9:
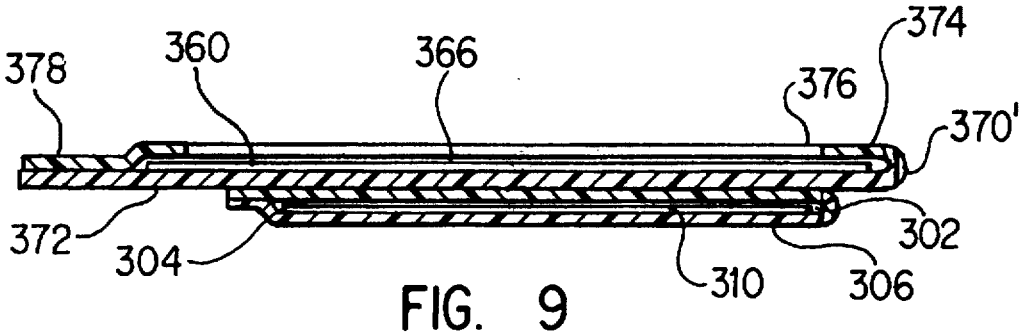
FIG. 9 is a cross-sectional view showing an alternate construction for the jacket of the embodiment of FIGS. 6 and 8.

In the embodiment of FIGS. 6 and 8, the pocket 304 and the opening for receiving card member 360 may each be formed by a single sheet of material which is folded over and secured to form respective opposing walls of the jacket 370' and pocket 304, as shown in FIG. 9. Therefore, the first and second walls 372 and 374 are formed by a single piece of sheet material which is folded and joined together at opposing ends of the sheet material to form the extended portion 378 of jacket 370'. The thus formed rear wall 374 is provided with the opening 376 through which the recording section 366 is accessed. Pocket 304 is formed by a single sheet of material folded to form third wall 302 and fourth wall 306, third wall 302 being secured to the external surface of the wall 372. While the pocket 304 is shown to be formed by a single sheet of material, such could be formed by two separate wall members which are joined together to form the pocket 304, with such pocket being then subsequently secured to the wall 372.

Figure 11:
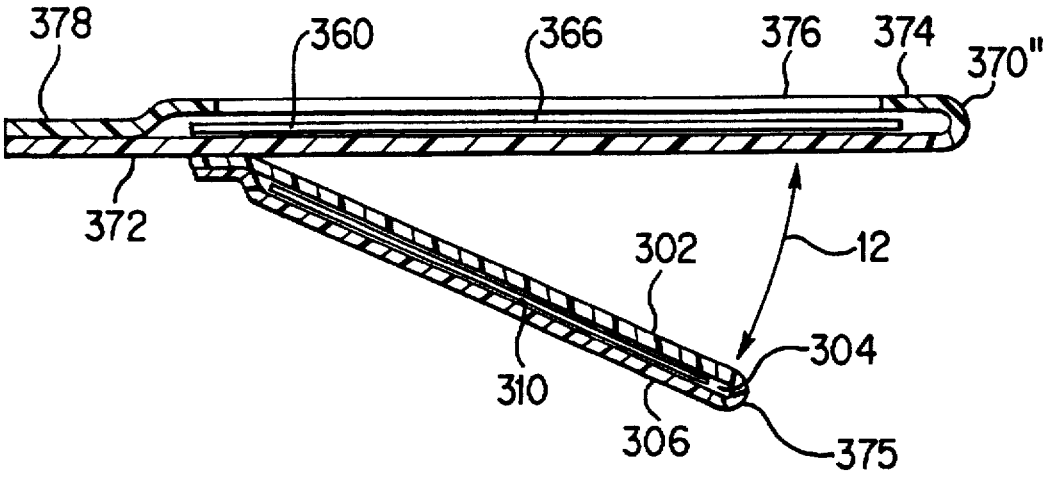

Conventional sports figure trading cards typically have a photographic-like image indicia side, and they typically have historical statistical data printed on the opposing side of the trading card. As users may wish to view the printed matter on the second side of the trading card, score tracking device 10 may be adapted to accommodate that function with jacket 370". Jacket 370" provides the means to view the rear side of the tracking card 310 without requiring removal of the trading card from the protective jacket pocket 304, as shown in FIG. 11. Jacket 370" is constructed much like that of jacket 370' (FIG. 9), with the exception that the wall member 302 is secured to wall member 372 on only a single peripheral edge portion, with the adjacent unsecured plastic wall portions forming a hinge-like arrangement wherein the opposing side edge 375 may be displaced from the wall 372, as indicated by directional arrow 12, to allow viewing of the rear side of trading card 310 without requiring removal from jacket 370".

The enjoyment of score keeping game system 100 is enhanced when a plurality of score tracking devices 10 are grouped together and maintained within the binder 42. The enjoyment of game system 100 is further enhanced by establishing which of the plurality of athletes whose accomplishments are being tracked is leading the others, performing better. In order to allow the user to identify which of the plurality of score tracking devices 10 is associated with an athlete who, at that time, is outperforming the others, game system 100 includes a removable identifier 50. As shown in FIG. 1, the removable identifier 50 is associated with a particular score tracking device 10 of the plurality of score tracking devices, allowing the user to quickly refer to the identified jacket. Removable identifier 50, as shown in FIG. 10A, may be formed by a planar rectangular member having an indicia area portion 52 formed on one end thereof for indicating a particular attribute thereon. Indicia area 52 may have a specific identifying indicia, such as "home run leader", "rushing leader", or the like printed thereon, and may also be color coded in order to draw attention thereto or distinguish one type attribute from another. Removable identifier 50 is inserted with card member 60 into jacket 70, and then may be transferred from one to another as the performance of one athlete relative to another changes throughout a season, add enjoyment to the following of a sport. As shown in FIG. 8, removable identifier 50 may be similarly inserted within the jacket 370, adjacent the non-apertured wall of jacket 370.

Figure 10B:
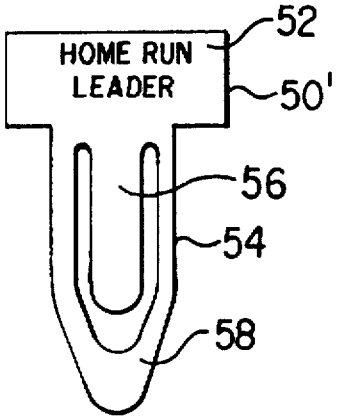
FIG. 10B is an alternate embodiment of the removable identifier of the present invention; and, FIG. 11 is a cross-sectional view of another structure for the jacket of the embodiment of FIGS. 6 and 8 of the present invention.
Figure 10A:
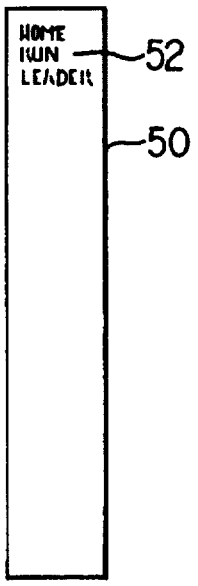
FIG. 10A is an elevation view of a removable identifier of the present invention.

Alternately, the removable identifier may be in the form of a clip, as shown in FIG. 10B. As shown, the removable identifier clip 50' includes an upper portion having an indicia area 52, from which extends a clip portion 54. Clip portion 54 has a conventional structure wherein there is provided a cantilevered central tab 56 and cantilevered outer tab 58, for releasable securement to the wall or walls of a jacket 70, 170, 270, 370, 370', 370" or card member 60, 160, 360 therebetween. Score keeping game system 100 may include a plurality of removable identifiers 50, 50', each having differing indicia printed in indicia area 52 to indicate differing achievement goals which may be obtained by the athletes whose performances are being tracked. As a further alternative, the indicia area of removable identifier 50, 50' may be coated so as to provide an erasable surface upon which the users can provide their own identification information. Still further, the identification information may be provided on adhesive-backed labels, which may be selectively applied to the area 52 on the removable identifier 50, 50'.

Thus it can be seen that score keeping game system 100 enhances the pleasure obtained in collecting trading cards of sports figures or the following of a fantasy sports team. It is not beyond the scope of the instant invention to provide for tracking the performance of other than sports figures. The trading cards may incorporate one or more recording sections thereon, allowing the user to provide an indication thereon each time the particular player accomplishes a particular achievement, such as hitting a home run, scoring a touchdown, etc. Each such trading card is maintained within a protective jacket, the jacket having an opening formed in at least one wall thereof for accessing the one or more recording sections of the trading card. Alternately, a separate score keeping card and an associated conventional trading card may be maintained together in a double-pocketed jacket, the jacket having an opening formed through one wall thereof for access to the recording sections of the scoring card. By maintaining a plurality of such jackets together, captured within a binder, a user can easily transport the binder to a sports activity where the particular athletes are performing, and track their performance while observing the sports activity. As a tracking set 40, the user can track the performance of a whole team, real or fantasy, using a team score tracking device 10' to accumulate the team's statistics thereon. While the recording area of the score keeping card or area of the trading card may be marked with a conventional marking device, such as a felt-tip type pen, other marking devices, such as a stamp, may also be used. It is further contemplated that the recording area may have symbols, pre-marked thereon and overlaid by a removable layer, allowing for a "scratch off" type system, with the marking device 30 having a small chisel-like tip to allow for removal of the covering layer in a discrete area of the recording section of the card. It can therefore be seen that score keeping game system 100 enhances both the enjoyment of collecting sports figure trading cards and observing the associated sporting events, as well as the review of publications for obtaining the personal statistics of players whose performance is being tracked.

Although this invention has been described in connection with specific forms and embodiments thereof, it will be appreciated that various modifications other than those disclosed above may be resorted to without departing from the spirit or scope of the invention. For example, equivalent elements may be substituted for those specifically shown and described, certain features may be used independently of other features, and in certain cases, particular locations of elements may be reversed or interposed all without departing from the spirit or scope of the invention as defined in the appended claims.

What is claimed is:

1. A score keeping game system for tracking an athlete's performance, comprising:

a card member having opposing first and second planar sides, at least one of said first and second planar sides having at least one section thereof being indicated by indicia as a recording section for recording the athlete's achievements thereon, said card member including a photographic-like image indicia section formed thereon, said image indicia section having a likeness of the athlete formed thereon; and, a pair of transparent wall members joined together to form a jacket open on at least one edge portion thereof to receive said card member therein, a first of said pair of transparent wall members having an opening formed therethrough, said opening being aligned and dimensioned for accessing said recording section of said card member.

2. The score keeping game system as recited in claim 1 further comprising a plurality of said card members and a plurality of said jackets for respectively receiving said plurality of card members therein.

3. The score keeping game system as recited in claim 2 where each of said plurality of jackets includes an extended portion formed on one edge thereof.

4. The score keeping game system as recited in claim 3 further comprising means for capturing said plurality of jackets between a pair of cover members, said capturing means engaging each of said plurality of jackets by said extended portion thereof.

5. The score keeping game system as recited in claim 4 further comprising means for marking said recording section of said card member to display an indicia pattern thereon.

6. The score keeping game system as recited in claim 5 where said marking means includes stamping means for marking a predetermined indicia pattern on said recording section of said card member.

7. The score keeping game system as recited in claim 4 further comprising a plurality of adhesive backed labels for securement to predetermined areas of said card member, said plurality of labels each having differing indicia formed on a front surface thereof.

8. The score keeping game system as recited in claim 1 where said photographic-like image indicia section is formed on said second side of said card member.

9. The score keeping game system as recited in claim 1 where said photographic-like image indicia section is formed on said first side of said card member.

10. The score keeping game system as recited in claim 9 where said opening in said first transparent wall member is contoured to provide a portion of said first transparent wall member in overlaying relationship with said photographic-like image indicia section.

11. A score keeping game system for tracking an athlete's performance, comprising:

a card member having opposing first and second planar sides, at least one of said first and second planar sides having at least one section thereof being indicated by indicia as a recording section for recording the athlete's achievements thereon, said card member including at least one section on said second side thereof indicated by indicia for recording the athlete's achievements thereon; and, a pair of transparent wall members joined together to form a jacket open on at least one edge portion thereof to receive said card member therein, a first of said pair of transparent wall members having an opening formed therethrough, said opening being aligned and dimensioned for accessing said recording section of said card member, a second of said pair of transparent wall members having an opening formed therethrough, said opening being aligned and dimensioned for accessing said recording section on said second side of said card member.

12. A score keeping game system for tracking an athlete's performance, comprising:

a card member having opposing first and second planar sides, at least one of said first and second planar sides having at least one section thereof being indicated by indicia as a recording section for recording the athlete's achievements thereon; and, a pair of transparent wall members joined together to form a jacket open on at least one edge portion thereof to receive said card member therein, a first of said pair of transparent wall members having an opening formed therethrough, said opening being aligned and dimensioned for accessing said recording section of said card member, said jacket including at least a third transparent wall member overlaying a second of said pair of transparent wall members and secured thereto to form a pocket for receiving a trading card therein.

13. A score keeping game system for tracking an athlete's performance, comprising:

a card member having opposing first and second planar sides, at least one of said first and second planar sides having at least one section thereof being indicated by indicia as a recording section for recording the athlete's achievements thereon; and, a pair of transparent wall members joined together to form a jacket open on at least one edge portion thereof to receive said card member therein, a first of said pair of transparent wall members having an opening formed therethrough, said opening being aligned and dimensioned for accessing said recording section of said card member, said jacket including a third transparent wall member and a fourth transparent wall member secured together and open along one edge to form a pocket for receiving a trading card therein, said pocket overlaying a second of said pair of transparent wall members and secured thereto along one edge of said pocket to form a hinge-like coupling therewith.

14. A game system for tracking performance of a plurality of athletes, comprising:

a plurality of card members, each of said plurality of card members having opposing first and second planar sides and at least one of said first and second planar sides having at least one section thereof indicated by indicia for recording achievements of a respective one of the plurality of athletes thereon;

a plurality of transparent jackets, each of said plurality of transparent jackets being formed by a pair of transparent wall members joined together with an opening formed between said pair of wall members on at least one edge of said jacket for receiving a respective one of said plurality of card members therein, a first of said pair of transparent wall members having an opening formed therethrough, said opening in said first wall member being aligned and dimensioned for accessing said recording section of a respective one of said plurality of card members, each of said plurality of jackets including an extended portion formed on one edge thereof, each of said plurality of jackets including at least a third transparent wall member overlaying a second of said pair of transparent wall members and secured thereto to form a pocket for receiving a trading card therein; and, means for capturing said plurality of jackets between a pair of cover members, said capturing means engaging each of said plurality of jackets by said extended portion thereof.

15. The game system as recited in claim 14 where each of said plurality of jackets includes a third transparent wall member and a fourth transparent wall member secured together and open along one edge to form a pocket for receiving a trading card therein, said pocket overlaying a second of said pair of transparent wall members and secured thereto along one edge of said pocket to form a hinge-like coupling therewith.

16. The game system as recited in claim 14 further comprising a plurality of adhesive backed labels for securement to predetermined areas of said plurality of card members, said plurality of labels each having differing indicia formed on a front surface thereof.

17. The game system as recited in claim 14 where each of said plurality of card members includes at least one section on said second side thereof indicated by indicia for recording a respective athlete's achievements thereon, a second of said pair of transparent wall members of each of said plurality of jackets having an opening formed therethrough, said opening being aligned and dimensioned for accessing said recording section on said second side of a respective card member.

* * * * *